US006206718B1

(12) United States Patent
Takahashi et al.

(10) Patent No.: US 6,206,718 B1
(45) Date of Patent: Mar. 27, 2001

(54) CONNECTING TERMINAL AND CIRCUIT BREAKING DEVICE

(75) Inventors: Hideo Takahashi; Noboru Yamaguchi, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/575,681

(22) Filed: Jun. 29, 2000

(30) Foreign Application Priority Data

Jul. 15, 1999 (JP) ..... 11-202075

(51) Int. Cl.[7] ..... H01R 4/38
(52) U.S. Cl. ..... 439/382; 439/801; 439/474
(58) Field of Search ..... 439/382, 383, 439/384, 809, 811, 791, 801, 474

(56) References Cited

U.S. PATENT DOCUMENTS 4,519,668 * 5/1985 Fujita et al. ..... 439/801
4,900,259 * 2/1990 Ludwig et al. ..... 439/801
5,167,513 * 12/1992 Johnson et al. ..... 439/474

* cited by examiner

*Primary Examiner*—Paula Bradley
*Assistant Examiner*—Tho D. Ta
(74) *Attorney, Agent, or Firm*—Finnegan, Henderson, Farabow, Garrett & Dunner, L.L.P.

(57) ABSTRACT

A connecting terminal and a circuit breaking device having the connecting terminal are provided. A plate-shaped second bus-bar 19 welded to a conductive thermit casing 26 through a low melting point metal 23. The bus-bar 19 has an orifice 20 formed to fix a wire with a terminal body by thread fastening and a thin part 51 formed between the orifice 20 and the metal 23 to have a plate thickness smaller than that of the other portion of the bus-bar 19. The thin part 51 is provided with wedge-shaped notches 53. When fastening a screw inserted into the orifice 20 in a clockwise or counterclockwise direction, a stress resulting from the rotation is absorbed by the thin plate 51 and the notches 53 in pairs. Consequently, owing to the absorption, it is possible to restrict the stress from being transmitted to the welding part of the low melting point metal 23.

10 Claims, 8 Drawing Sheets

CONNECTING TERMINAL AND CIRCUIT BREAKING DEVICE

CROSS-REFERENCE TO RELATED APPLICATIONS

Not Applicable.

STATEMENT REGARDING FEDERALLY SPONSORED RESEARCH

Not Applicable.

REFERENCE TO A MICROFICHE APPENDIX

Not Applicable.

BACKGROUND OF THE INVENTION

1. Description of Related Art

In an electrical installation system on a vehicle, when electrical loads, such as a power window, has any malfunction or when a wire harness composed of a plurality of electrical wires connecting a battery with respective loads has any trouble, the system generally operates to melt a fuse for great current interposed between the battery and the wire harness. As a result, the connection between the battery and the wire harness is broken to prevent respective loads, wire harness, etc. from being damaged.

In the above-mentioned electrical installation system, however, the great current fuse does not melt unless the current in excess of a predetermined allowable value flows through the fuse in spite of the occurrence of the above abnormalities. Therefore, there are a variety of protecting devices under development, which can detect the continuous flowing of a large current close to the allowable value and further break the connection between the battery and the wire harness.

In these protecting devices, FIG. 1 is a longitudinal sectional view showing one protecting device using a bimetal. The shown protecting device is made of insulating resin and others and comprises the following elements: a housing 103 provided, on its upper side, with a fuse container 102; a lid 113 closing the fuse container 102 of the housing 103; a power terminal 105 disposed in the lower side of the housing 103 and having its upper end projecting into the container 102 and the exposed lower end connected to a positive (+) terminal of a battery 104; a load terminal 109 also disposed in the lower side of the housing 103 and having its upper end projecting into the container 102 and the exposed lower end connected to a load 108 through a wire 107 forming a wire harness 106; a soluble member 110 constituted by low-melting point metals in the container 102 and having one end connected to the upper end of the power terminal 105 and the other end connected to the upper end of the load terminal 109; an intermediate terminal 111 disposed in the lower side of the housing 103 to take a middle position between the power terminal 105 and the load terminal 109 and having the terminal's exposed lower end connected to a negative (−) terminal of the battery 104; and a bimetal 112 formed to be a long plate member consisting of two different glued metals and also having a lower end connected to the upper end of the intermediate terminal 111 and the upper end bent in a L-shaped manner to face the soluble member 110.

Under condition that the current flows in order of the positive terminal of the battery 104, the power terminal 105, the soluble member 110, the load terminal 109, the wire 107 of the wire harness 106, the load 108 and the negative terminal of the battery 104 upon the manipulation of an ignition switch of the vehicle etc., when any trouble arises in either the load 108 or the wire harness 106 connecting the load 108 with the protection device 101 so that the current exceeding the allowable value flows through the soluble member 110, it is heated and molten off to protect the load 108 and the wire harness 106.

Alternatively, even when the current does not exceed the allowable value despite a great current flowing through the soluble member 110 due to any abnormality in either the load 108 or the wire harness 106 connecting the load 108 with the protection device 101, the soluble member 110 is still heated by the current flowing therethrough, so that the bimetal 112 begins to be deformed. At a point of time when a predetermined period has passed since the great current began to flow through the soluble member 110, the tip of the bimetal 112 finally comes into contact with the soluble member 110, so that a large short-circuit current flows through the soluble member 110 in the following order of the positive terminal of the battery 104, the power terminal 105, the soluble member 110, the load terminal 109, the wire 107 of the wire harness 106, the load 108 and the negative terminal of the battery 104 and finally, the soluble member 110 is broken off in heat.

In this way, even when the current less than the allowable value continues to flow in excess of the predetermined period, the circuit is broken off thereby to protect the wire harness 106 and the load 108.

Besides the above protecting device 101, another protecting device 121 shown in FIG. 2 has been under development.

The shown protecting device 121 includes the following elements: a housing 122 made of insulating resin or the like; a power terminal 124 embedded in one side of the housing 122 and having the terminal's lower end connected to a positive (+) terminal of a battery 123; a load terminal 128 also embedded in the other side of the housing 122 and having the terminal's lower end connected to a load 127 through a wire 126 forming a wire harness 125; a wire 131 consisting of an U-shaped soluble lead 129 of low-melting point metals etc. and a heat resistant cover 130 covering the lead 129, and also having one end connected to the upper end of the power terminal 124 and the other end connected to the upper end of the load terminal 128; a coil 132 of shape-memory alloy, which is previously memorized in its shape so as to wind around the wire 131 when the coil 132 is in the phase of martensite, whereas fasten the wire 131 in the mother phase when heated up to 120–170° C.; and an exterior terminal 133 arranged outside the housing 122 and having the terminal's upper end connected to one end of the coil 133 and the other end connected to a negative (−) terminal of a battery 123.

Under condition that the current flows in order of the positive terminal of the battery 123, the power terminal 124, the soluble lead 129 of the wire 131, the load terminal 128, the wire 126 of the wire harness 125, the load 127 and the negative terminal of the battery 123 as a result of manipulating the ignition switch etc. and if any trouble arises in either the load 127 or the wire harness 125 connecting the load 127 with the protection device 121 so that the current exceeding the allowable value flows through the soluble lead 129, then it is heated and molten off to protect the load 127 and the wire harness 125 etc.

Alternatively, even if the current does not exceed the allowable value despite a great current flowing through the soluble lead 129 due to any abnormality in either the load 127 or the wire harness 125 connecting the load 127 with the protection device 121, the soluble lead 129 is still heated by the current flowing therethrough, so that the temperature of the coil 132 rises. When the temperature of the coil 132 reaches 120–170° C. as a result of passage of a predetermined period since the great current began to flow through the soluble lead 129, the coil 132 transfers from the martensite phase to the mother phase and encroaches on the heat resistant covert 130 being softened by heat. As a result, the coil 132 comes into electrical contact with the soluble lead 129, so that a large short-circuit current flows through the soluble member 110 in the sequent course of the positive terminal of the battery 123, the power terminal 124, the soluble lead 129, the coil 132, the exterior terminal 133 and the negative terminal of the battery 123 and finally, the soluble lead 129 is broken off in heat.

In this way, even when the current less than the allowable value continues to flow in excess of the predetermined period, the circuit is broken off to protect the wire harness 125 and the load 127.

Nevertheless, the above-mentioned protecting devices 101, 121 still have problems as follows.

First, in the former protecting device 101 of FIG. 1, when the magnitude of current flowing the soluble member 110 changes, the bimetal 112 is deformed to change a period required to cut off the circuit due to the structure of the bimetal 112 where two kinds of metals of different rates of thermal expansion are glued each other.

Therefore, if there is caused a malfunction that an excessive current flows discontinuously, the temperature of the soluble member 110 does not rise in excess of a certain degree any longer, so that the wire harness 106, the load 108, etc. may be subjected to thermal damage before the protecting device 101 serves to cut off the circuit.

While, since it is detected whether an excessive current flows through the soluble lead 129 by the coil 132 of shape-memory alloy in the latter protecting device 121 of FIG. 2, when the magnitude of current flowing the soluble lead 129 changes, the coil 132 is deformed to change a period required to cut off the circuit.

Therefore, if there is caused a malfunction that the excessive current flows discontinuously, the temperature of the soluble lead 129 does not rise in excess of a certain degree any longer, so that the wire harness 125, the load 127, etc. may be heated excessively before the protecting device 121 serves to cut off the circuit.

Further, the bimetal and the shape-memory alloy coil are commonly characterized by their relatively-low deformation starting points (approx. 100° C.), these elements are unsuitable to be used in a temperature range from 120 to 125° C. corresponding to a temperature situation where the vehicle is in general use.

In the protecting devices of FIGS. 1 and 2, the bimetal 112 and the coil 132 (as heat-deformable and conductive members) commonly have variable heat-reactive periods influenced by the magnitude of currents. Additionally, these protecting devices have a common drawback that the heat-deformable and conductive members cannot operate at the occurrence of abnormality (excessive current) timely.

Besides the above-mentioned devices, there is a circuit breaking device under development, which comprises a pair of connecting terminals (one for battery; the other for load) and a conductive member in electrical contact with the above connecting terminals. In operation, when the vehicle has an abnormality, the conductive member is broken or shifted to cut off the electrical connection between the connecting terminal for battery and the connecting terminal for load, thereby breaking the circuit.

In this circuit breaking device under development, the connecting terminals are joined to the conductive member by means of soldering. Furthermore, the connecting terminal for battery is fixed to a wire for battery through a fastened screw etc., while the connecting terminal for load is also fixed to a wire for load through a fastened screw etc.

In the above-mentioned circuit breaking device, however, an inferior soldering sometimes arises from the screw-fastening in fixing the respective connecting terminals with the wires since an external stress is transmitted from each connecting terminal to the joint (soldering) part. Consequently, there is a problem of defective connection between the connecting terminals and the conductive member.

2. Field of the Invention

The present invention relates to a conductive connecting terminal to be joined to a conductive member, such as a thermit case, through a material of low melting point. Further, the invention also relates to a circuit breaking device with the above connecting terminal, which can break an electric circuit in a short time.

SUMMARY OF THE INVENTION

Under the circumstances, it is therefore an object of the present invention to provide a connecting terminal which is capable of restricting the transmission of external force to the joint part, such as the solder, and a circuit breaking device with the connecting terminal, which can rapidly and certainly break the circuit when an abnormal signal about the vehicle is inputted, allowing electrical components to be protected.

The object of the present invention described above can be accomplished by a connecting terminal for connection with a wire and an electrically conductive member, comprising a terminal body in the form of an electrically conductive plate; a screw-fastening part of the terminal body, which is positioned on an end portion thereof, for electrical connection with the wire; a leading part of the terminal body, which is positioned on the other end of the terminal body, for electrical connection with the electrically conductive member; and a thin part of the terminal body, which is interposed between the screw-fastening part and the leading part and which has a plate thickness smaller than the plate thickness of other parts of the terminal body.

Owing to the formation of the tin part between the screw-fastening part and the leading part, when fastening a screw into the screw-fastening part, the thin part is bent to absorb the external stress. In this way, it is possible to restrict the transmission of stress to the leading part of the terminal body, that is, the joint part between the electrically conductive member and the connecting terminal.

According to the second aspect of the invention, the thin part is provided, on opposing edges thereof, with notches. In this case, owing to the provision of the notches, the deformation of the thin part is facilitated furthermore.

According to the third aspect of the invention, the screw-fastening part comprises an orifice for receiving a screw. In this case, the screw is inserted and fastened to screw-fastening part in order to fix the wire with the terminal body.

According to the fourth aspect of the invention, at least one portion of the leading part is bent at general right angles to the thin part and the screw-fastening part. Owing to the formation, it is possible to ensure a great contact area between the connecting terminal and the electrically conductive member.

According to the fifth aspect of the invention, the leading part and thin part are together bent at general right angles to the screw-fastening part. Also in this case, it is possible to ensure a great contact area between the connecting terminal and the electrically conductive member.

According to the sixth aspect of the invention, the thin part is provided with irregularities in place of the above notches.

Owing to the formation of the irregularities between the screw-fastening part and the leading part, when fastening a screw into the screw-fastening part, the external stress can be absorbed by the irregularities. Thus, it is possible to restrict the transmission of external stress to the leading part of the terminal body.

According to the seventh aspect of the invention, the screw-fastening part comprises an orifice for receiving a screw, in addition to the provision of the irregularities on the thin part.

According to the eighth aspect of the invention, at least one portion of the leading part is bent at general right angles to the thin part and the screw-fastening part.

According to the ninth aspect of the invention, the irregularities comprise at least one depression traversing the thin part in its width direction.

Owing to the formation of the depression between the screw-fastening part and the leading part, when fastening a screw into the screw-fastening part, the external stress can be absorbed by the depression on the thin part effectively.

According to the tenth aspect of the invention, in place of the depression, the irregularities may comprise at least one projection traversing the thin part in its width direction.

In this case, the external stress can be absorbed by the projection on the thin part effectively.

According to the eleventh aspect of the invention, there is also provided a circuit breaking device for a vehicle, comprising: first and second connecting terminals for connection with wires; an electrically conductive heating part arranged between the first connecting terminal and the second connecting terminal so as to be in contact with the first and second connecting terminals, the heating part having a heating drug therein and allowing to ignite the heating drug by inputting an abnormal signal generated on the outside of the heating part when the vehicle is subjected to an abnormal situation; a low melting point material interposed between the first connecting terminal and the heating part, for joining the heating part to the first connecting terminal; another low melting point material interposed between the second connecting terminal and the heating part, for joining the heating part to the second connecting terminal; an expandable elastic member arranged so as to be in contact with the heating part, for urging the heating part; an external container accommodating the expandable elastic member and the heating part therein; and resinous projections formed on the external container, for opposing to a press force of the elastic member on the heating part.

In the present invention, the first and second connecting terminals comprise in each, a terminal body in the form of a conductive plate; a screw-fastening part of the terminal body, which is positioned on an end portion thereof, for electrical connection with each of the wires; a leading part of the terminal body, which is positioned on the other end of the terminal body, for electrical connection with the heating part through each of the low melting point materials; and a thin part of the terminal body, which is interposed between the screw-fastening part and the leading part and which has a plate thickness smaller than the plate thickness of other parts of the terminal body.

According to the circuit breaking device mentioned above, when the heating drug is ignited by the outside abnormal signal, the resinous projections on the external container are molten by heat generated from the heading drug. Simultaneously, the elastic member stretches to move the heating part upward, so that the electrical connection between the first connecting terminal and the second connecting terminal is cut off to break the circuit, allowing the electrical components to be protected.

Also in this circuit breaking device, owing to the formation of the tin part between the screw-fastening part and the leading part of each connecting terminal, the thin part is bent to absorb the external stress in case of fastening the screw into the screw-fastening part. In this way, it is possible to restrict the transmission of stress to the leading part of each connecting terminal.

According to the twelfth aspect of the invention, the thin part of each connecting terminal is provided, on opposing edges thereof, with notches. Also in this case, owing to the provision of the notches, the deformation of the thin part is facilitated furthermore.

According to the thirteenth aspect of the invention, the thin part may be provided with irregularities in place of the above notches.

These and other objects and features of the present invention will become more fully apparent from the following description and appended claims taken in conjunction with the accompany drawings.

DESCRIPTION OF THE PREFERRED EMBODIMENTS

With reference to the drawings, we now describe a connecting terminal and a circuit breaking device having the above connecting terminal in accordance with an embodiment of the present invention.

Figure 1:
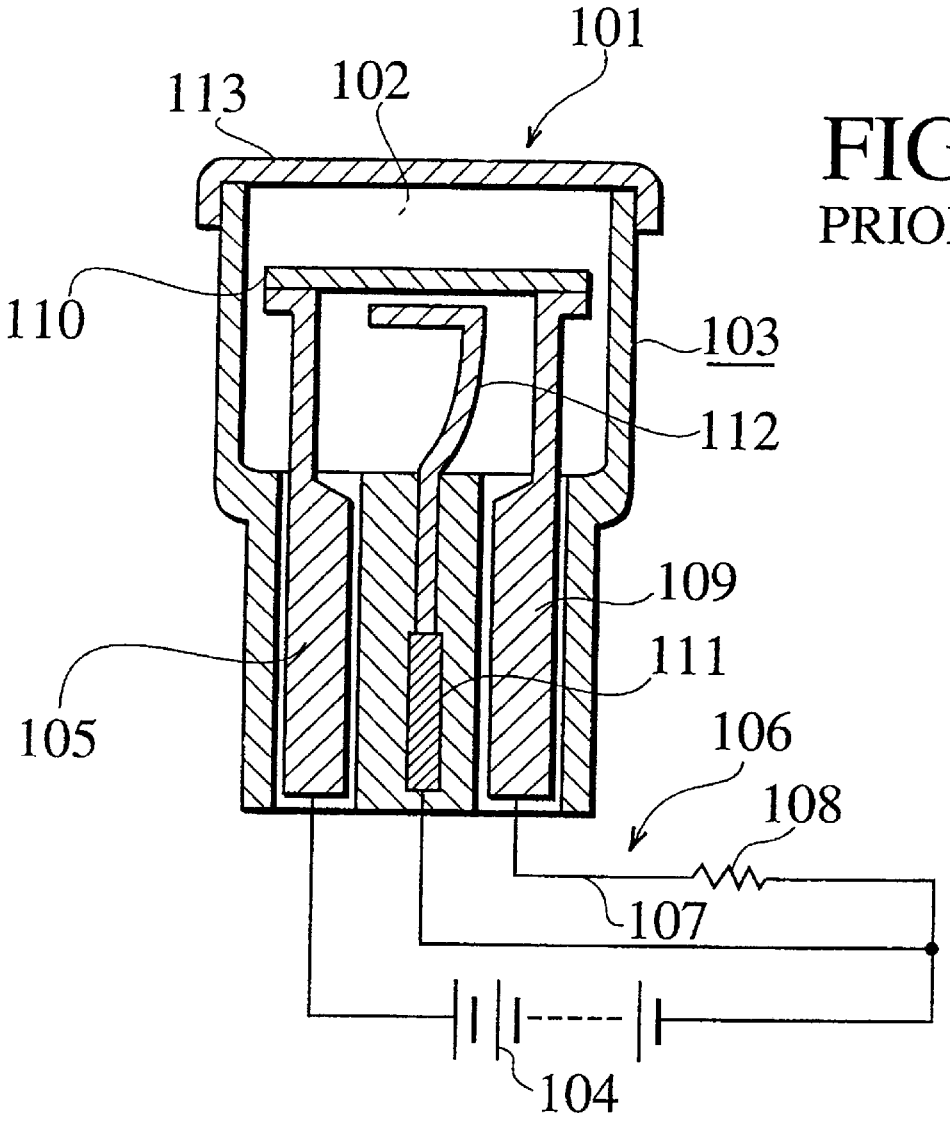
FIG. 1 PRIOR ART
FIG. 1 is a sectional view showing one example of the conventional protecting device using a bimetal.
Figure 2:
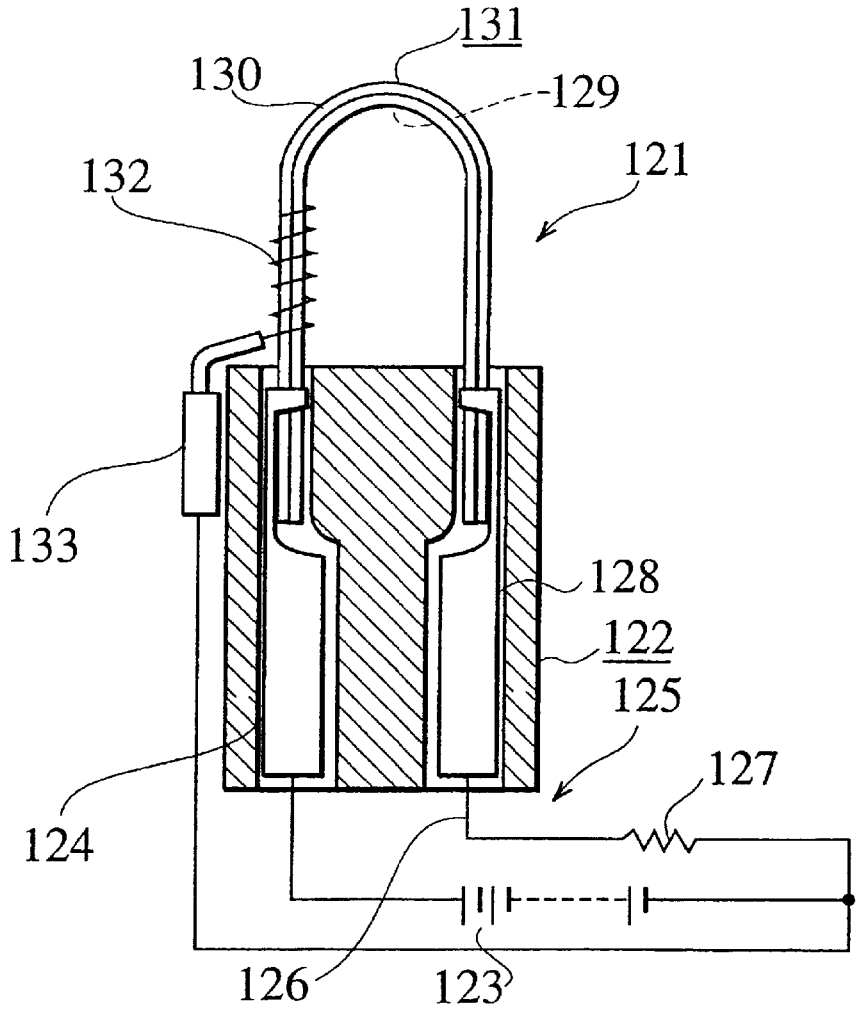
FIG.2 PRIOR ART
FIG. 2 is a sectional view showing another example of the conventional protecting device.
Figure 3:
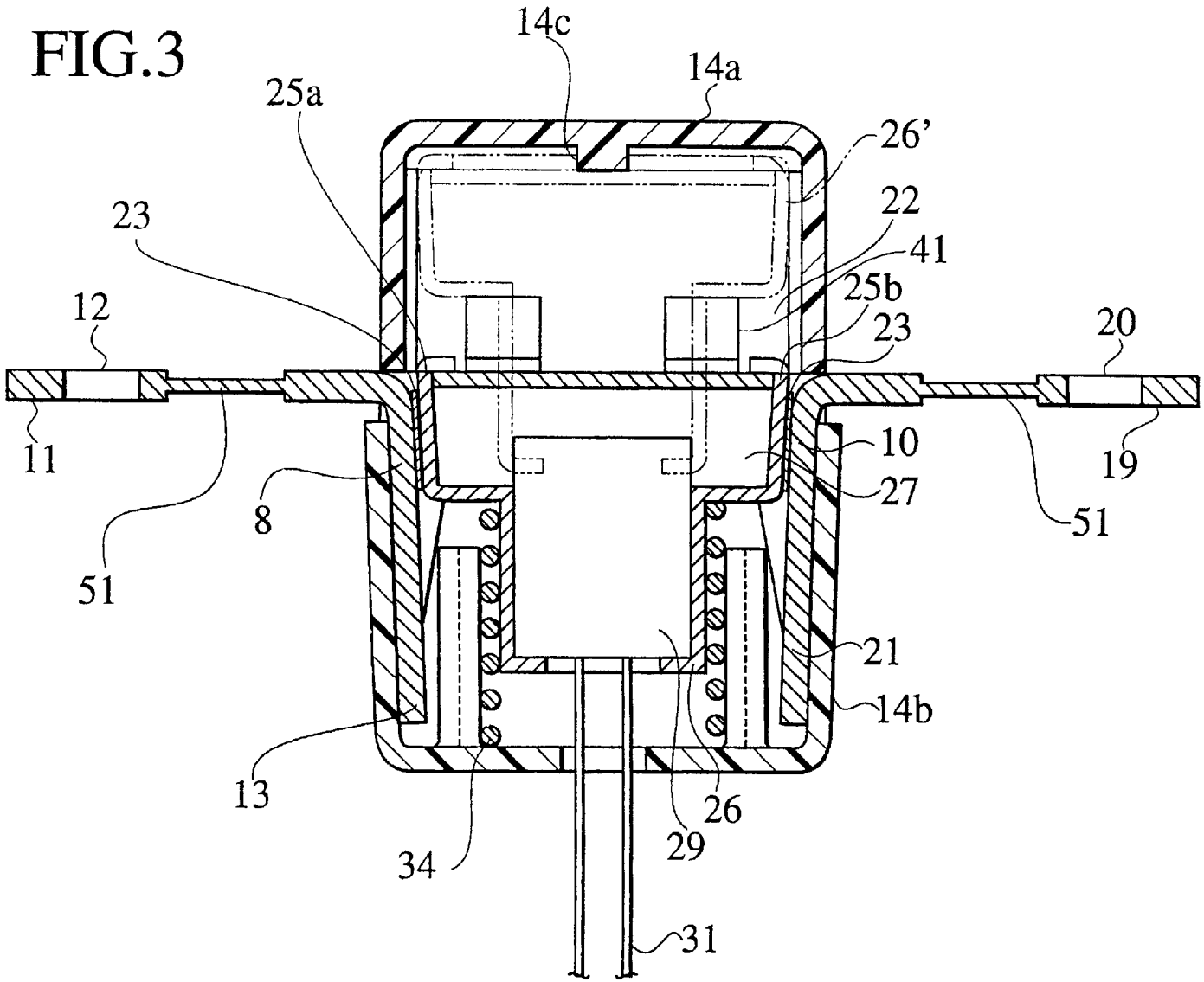
FIG. 3 is a sectional view of a circuit breaking device in accordance with an embodiment of the invention, taken along a line III—III of FIG. 4.
Figure 4:
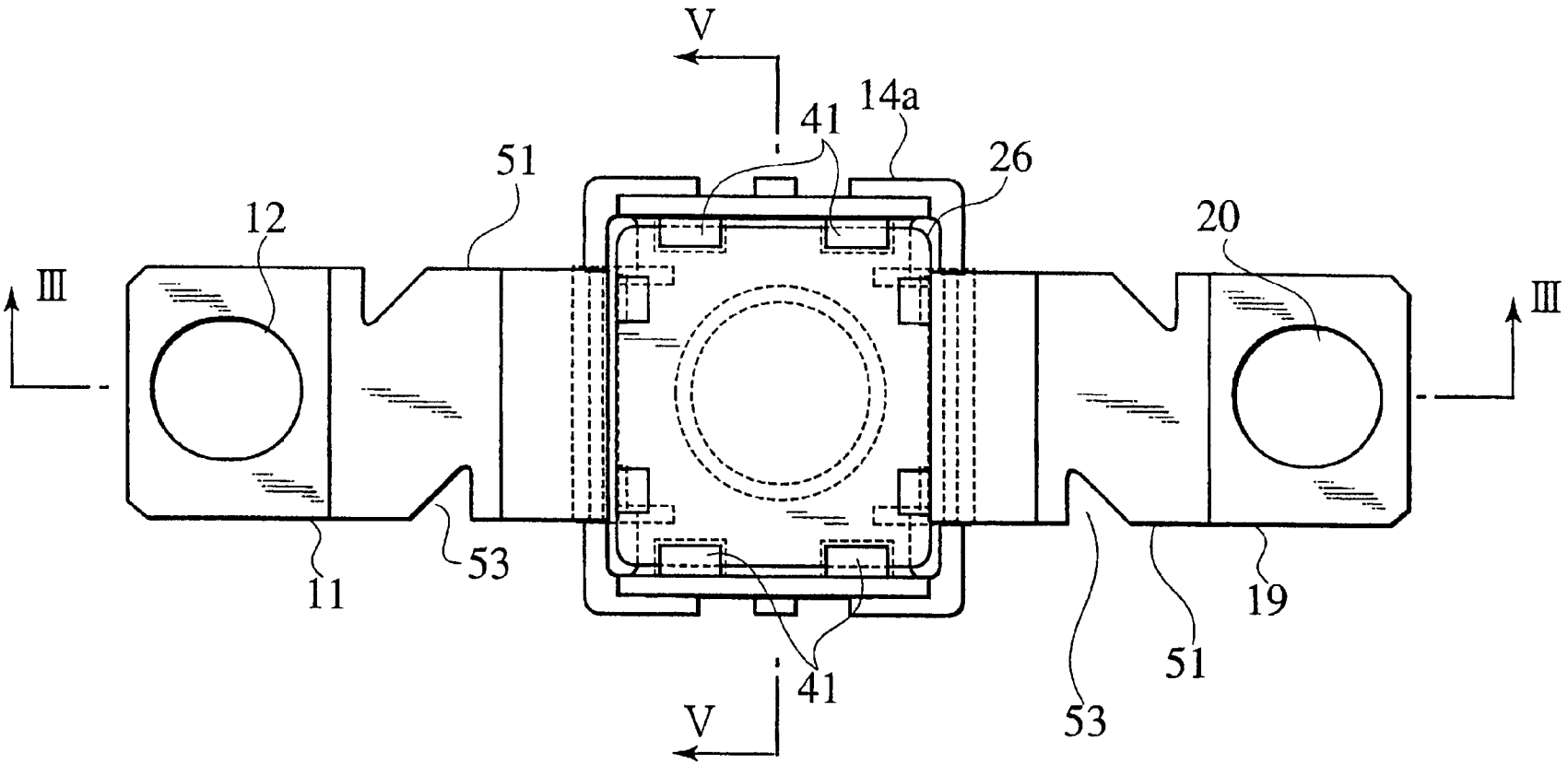
FIG. 4 is a top view of the circuit breaking device in accordance with the embodiment of the invention.
Figure 5:
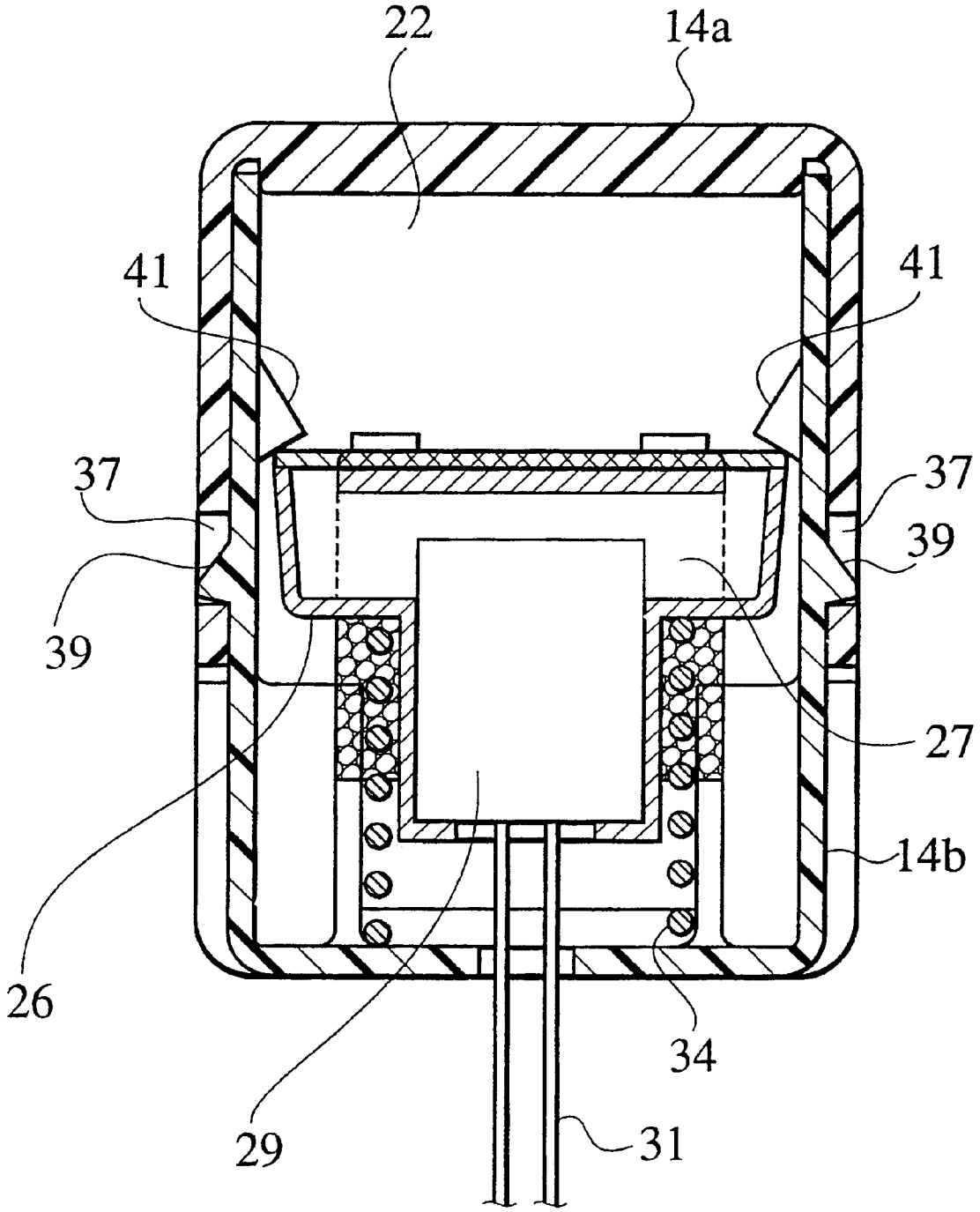
FIG. 5 is a sectional view of the circuit breaking device, taken along a line V—V of FIG. 4.
Figure 6:
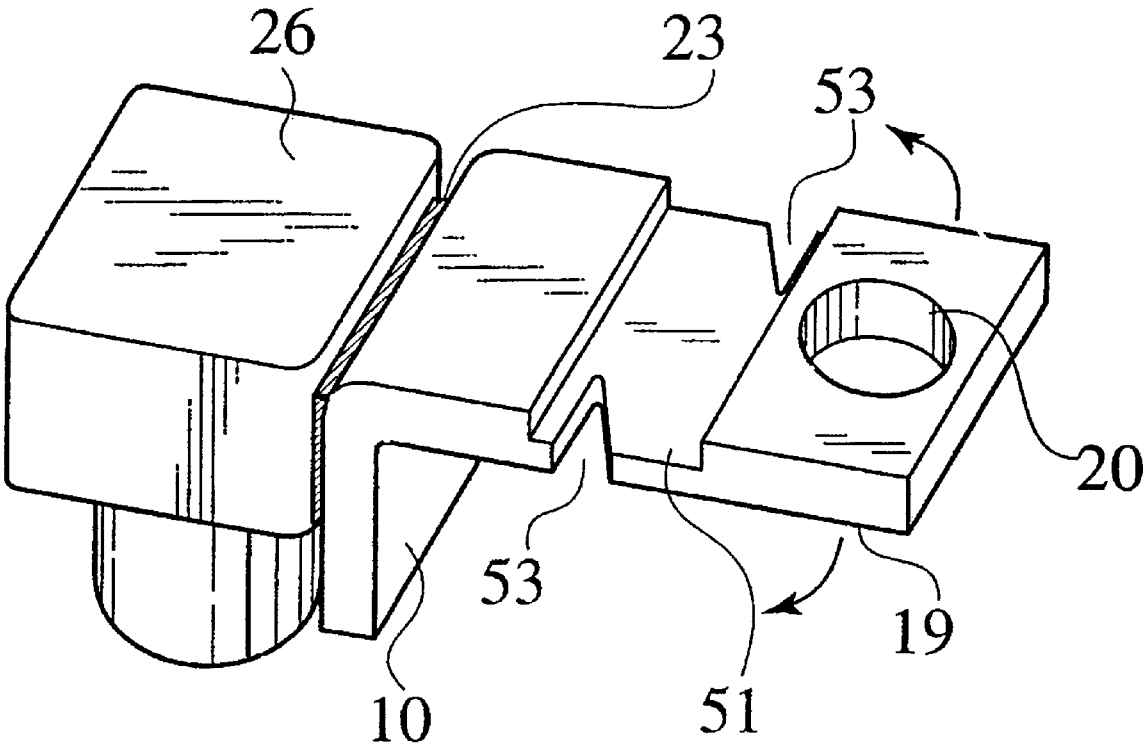
FIG. 6 is a perspective view of a thermit casing and a bus-bar of the circuit breaking device of the embodiment.

First, the circuit breaking device of the embodiment will be described. FIG. 3 is a sectional view of an automotive meter equipped with a connecting structure of a substrate connector in accordance with one embodiment of the invention. FIG. 3 is a sectional view of the circuit breaking device of the embodiment, taken along a line III—III of FIG. 4. FIG. 4 is a top view of the circuit breaking device in accordance with the embodiment of the invention. FIG. 5 is a sectional view of the circuit breaking device, taken along a line V—V of FIG. 4. FIG. 6 is a perspective view of a thermit casing and a bus-bar of the circuit breaking device of the embodiment.

In the circuit breaking device of FIG. 3, a first bus-bar 11 has a terminal body in the form of a long plate made of copper or copper alloy. The busbar 111 has an orifice 12 formed on an end of the terminal body, for receiving a screw (not shown) for fixing a wire (also not shown) with the terminal body. The end of the terminal body is connected to a not-shown battery through the wire. Similarly, a second bus-bar 19 has a terminal body in the form of a long plate made of copper or copper alloy. The second bus-bar 19 has an orifice 20 formed on its end of the terminal body, for receiving a screw (not shown). The end of the terminal body of the bus-bar 19 is connected to a not-shown electric load. The first bus-bar 11 and the second bus-bar 19 constitute a first connecting terminal and a second connecting terminal of the invention, respectively. The orifices 12, 20 of the first bus-bar 11 and the second bus-bar 19 constitute screw-fastening parts of the invention, respectively.

The first bus-bar 11 includes a thin part 51 formed between the orifice 12 and a low melting point metal 23 to have a thickness smaller than the other portions of the bar. Also in the second bus-bar 19, the thin part 51 is formed between the orifice 20 and the low melting point metal 23 to have a thickness smaller than the other portions of the bar. These thin parts 51 can be provided by machining or press-working the bus-bars. As shown in FIG. 4, each tin part 51 has two wedge-shaped notches 53 formed on opposing edge of the part 51.

Disposed between the first bus-bar 11 and the second bus-bar 19 are an upper casing 14*a* and a lower casing 14*b* both which define an inside cavity 22. The upper casing 14*a* and the lower casing 14*b* constitute an external container made of an insulating material, such as resin (thermoplastic resin).

The upper casing 14*a* has rectangular recesses 37 formed on its opposing sidewalls. While, the lower casing 14*b* has first projections 39 formed on its opposing sidewalls. When the lower casing 14*b* is covered with the upper casing 14*a*, the first projections 39 are engaged in the rectangular recesses 37 respectively, providing a closed casing. With the engagement between the casings 14*a*, 14*b*, there is no possibility that a thermit casing 26 rushes out of the upper casing 14*a* at the circuit's breaking and furthermore, it is possible to prevent the occurrence of trouble derived from the heated thermit casing 26.

The thermit casing 26 made of copper, copper alloy, etc. is accommodated in the lower casing 14*b* and filled up with a heating drug 27 and also an igniter 29. Preferably, the thermit casing 28 is made from a material, which exhibits high heat-transmission and does not melt in spite of heat of the heating drug 27, for example, copper pyrites, copper, copper alloy, stainless steel, etc.

As shown in FIG. 3, the first and second bus-bars 11, 19 have respective leading parts bent at general right angles to the thin parts 51, providing bending parts 8, 10, respectively. In arrangement, a left sidewall 25*a* of the thermit casing 26 is joined to the bending part 8 of the first bus-bar 11 by the low melting point metal 23, for example, solder (melting point: 200 to 300° C.). Similarly, a right sidewall 25*b* of the thermit casing 26 is joined to the bending part 10 of the second bus-bar 19 by the low melting point metal 23. Consequently, the first bus-bar 11 is electrically connected to the second busbar 19 through the low melting point metal(s) 23 and the thermit casing 26.

The low melting point metal 23 consists of at least one kind of metal to be selected from various metals, for example, Sn, Pb, Zn, Al and Cu.

The heating drug 27 is constituted by powder of metal oxide, such as iron oxide ($Fe_2O_3$), or aluminum powder, providing a thermit mixture which is capable of causing a thermit reaction generating a high fever owing to the heat-generation of lead lines 31. Note, in the heating drug 27, iron oxide ($Fe_2O_3$) may be replaced by chrome oxide ($Cr_2O_3$), manganese oxide ($MnO_2$) or the like.

As the heating drug 27, it may be constituted by at least one kind of mixture composed of at least one kind of metal powder to be selected from B, Sn, FeSi, Zr, Ti and Al and Cu; at least one kind of metal oxide to be selected from CuO, $MnO_2$, $Pb_3O_4$, $PbO_2$, $Fe_3O_4$ and $Fe_2O_3$; and an additive consisting of alumina, bentonite, talc, etc. With the adoption of constituents mentioned above, the heating drug 27 can be ignited by the igniter 29 with ease, whereby it is possible to melt the low melting point metal 23 in a short time.

The igniter 29 contains an ignition drug which can be ignited by heat generated by a current flowing the lead lines 3 at the vehicle's abnormality, such as the vehicle's collision. Thus, owing to the ignition of the igniter 29, the heating drug 27 is capable of generating the heat of thermit reaction.

As the expandable elastic member of the invention, a compression spring 34 is interposed between the thermit casing 26 and the lower casing 14*b*, for urging the thermit casing 26 upwards.

The lower casing 14*b* is provided, at an interior thereof, with second projections 41 consisting of resinous members. In assembly, the second projections 41 serve to depress the top face of the thermit casing 26 to prevent it from moving upward due to the spring force of the compression spring 34.

Next, we describe the operation of the so-constructed connecting terminal and also the operation of the circuit breaking device having the above terminal with reference to the drawings.

First, the screwing operation for the bus-bar as the connecting terminal of the invention will be described with reference to FIG. 6. Although FIG. 6 only illustrates the connection between the second bus-bar 19 and the thermit casing 26, the connecting form is applicable to the case of connecting the first bus-bar 11 with the thermit casing 26.

For example, when performing to insert a not-shown screw into the orifice 20 and subsequently fastening the screw in the clockwise direction, then the resultant clockwise rotating force causes the thin part 51 to be bent so as to open the upper notch 53 while closing the lower notch 53.

Thus, since the stress caused by fastening the screw can be absorbed by the deformation of the thin part 51 and the notches 53 in pairs, it is possible to prevent the stress from being transmitted to the joint part on the low melting point metal 23, whereby the inappropriate electric connection can be avoided. Additionally, since the vibration can be also absorbed by the thin part 51 and the notches 53 in pairs, it is possible to prevent the vibration from being transmitted to the joint part on the low melting point metal 23.

Further, since the bus-bar's portion except the thin part 51 is shaped to have a large thickness, there is no need to provide the bus-bar with any reinforcement means, such as flanges and beads, whereby the die machining can be simplified.

The circuit breaking device operates as follows. In the normal condition, the first bus-bar 11 and the second bus-bar 19 are electrically connected with each other through the low melting point metal 23 and the thermit casing 26, so that the current is supplied from the not-shown battery to the not-shown load.

Next, if the vehicle has a collision with an obstacle etc. or the vehicle falls over a precipice etc., then a collision sensor or the like detects an abnormality about the vehicle. Upon the detection of the abnormality, the current flows for the igniter 29 through the lead lines 31.

Then, since the igniter 29 takes fire owing to the heat generation by the current, the heating drug 27 as the thermit drug generates the thermit reaction heat in accordance with the following reaction formula: $Fe_2O_3+2Al \rightarrow Al_2O_3+2Fe+386.2$ Kcal.

By this thermit reaction heat, the thermit casing 26 is heated, so that the low melting point metal 23 connecting the bending part 8 with the left sidewall 25*a* and the other low melting point metal 23 connecting the bending part 10 with the right sidewall 25*b* are heated and molten owing to the heat generation of the heating drug 27 and the thermit casing 26. And simultaneously, the second projections 41 (resinous members) on the lower casing 14*b* are also molten by the above heat generation.

Then, the melting of the projections 41 causes the compressed spring 34 to be expanded, so that the thermit casing 26 accommodating the igniter 29 leaps up into the cavity 22. In FIG. 3, reference numeral 26 denotes the thermit casing 26' being shifted upward.

Consequently, the electrical connection between the thermit casing 26 and the first and second bus-bars 11, 19 is broken off. In other words, the first bus-bar 11 is electrically insulated from the second bus-bar 19, so that the electrical circuit of the vehicle is cut off.

In this way, according to the circuit breaking device of the embodiment, it is possible to intercept the electrical circuit of the vehicle rapidly and certainly, saving the electrical components. Additionally, owing to the utilization of the thermit reaction heat of the heating drug 27, it is possible to provide the circuit breaking device having a simple structure.

Furthermore, as the second projections 41 on the lower casing 14*b* withstand the upward expansion of the compression spring 34, it does not exert its spring force on the low melting point metals 23 between the first and second bus-bars 11, 19 and the thermit casing 26 thereby to improve the reliability of joint parts.

Figure 7:
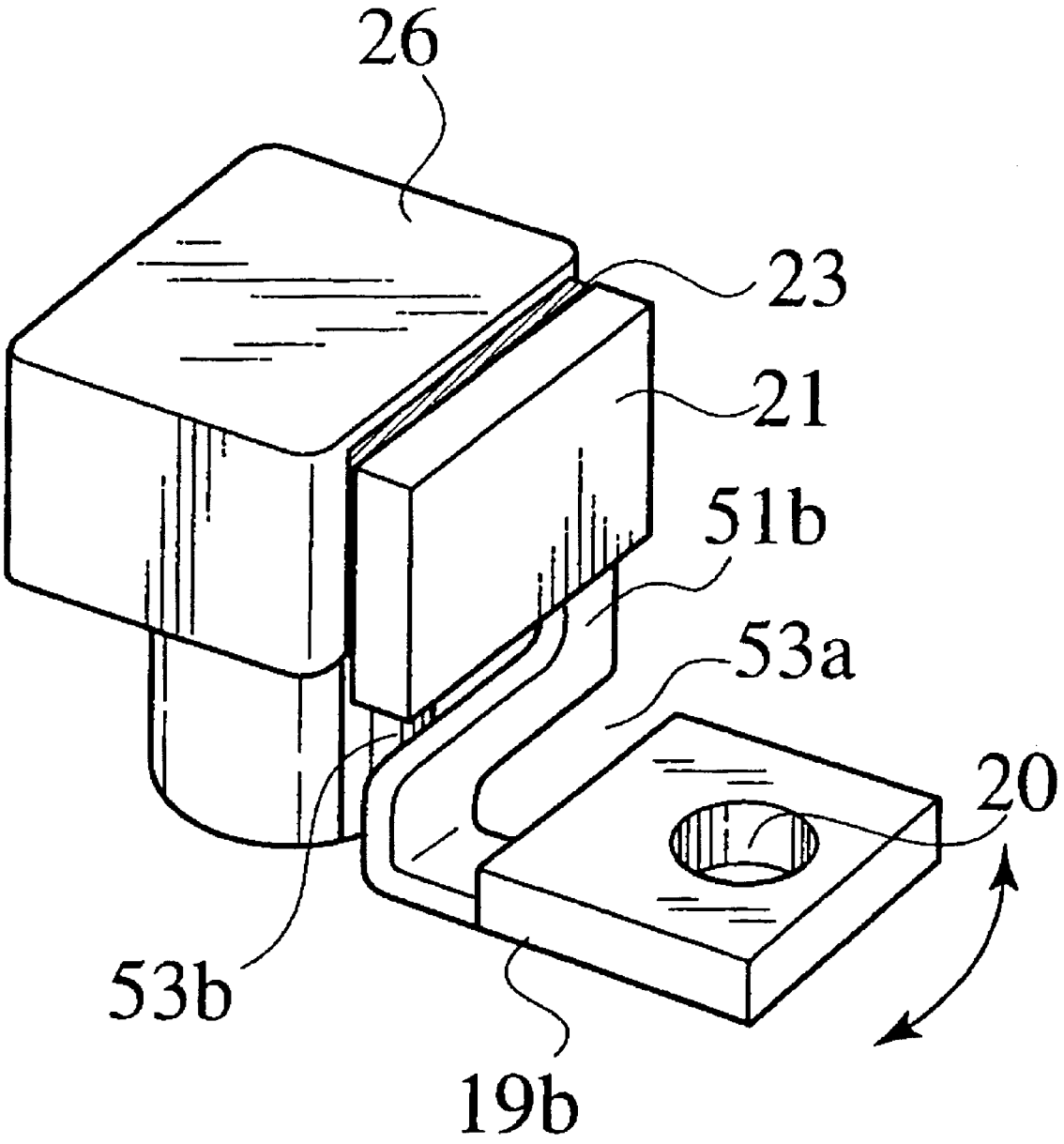
FIG. 7 is a perspective view of the thermit casing and the bus-bar in the first modification of the circuit breaking device.

Now, we describe the first modification of the circuit breaking device of the invention. FIG. 7 is a perspective view of the thermit casing and the bus-bar of the circuit breaking device, in accordance with the first modification of the embodiment.

Also in the modification, a second bus-bar 19*b* has the orifice 20 formed on one end of the bar and a thin part 51*b* formed between the orifice 20 and the joint part of the low melting point metal 23. Both of the thin part 51*b* and a leading part 21 of the bus-bar 19*b* are bent at general right angles to a bus-bar plane containing the orifice 20. The thin part 51*b* is also provided, on left and right sides thereof, with a pair of notches 53*a*, 53*b*.

he leading part 21 is welded to the thermit casing 26 through the low melting point metal 23. Note, the first bus-bar (not shown) has a structure identical to that of the above-mentioned second bus-bar 19*b* and therefore, the descriptions are eliminated.

With the above-mentioned arrangement, for example, when performing to insert a not-shown screw into the orifice 20 and subsequently fastening the screw in the clockwise direction or counterclockwise direction, the screwing stress is absorbed by the deformation of the thin part 51 and the pair of notches 53*a*, 53*b* in the rotating direction. Thus, it is possible to prevent the screwing stress from being transmitted to the joint part on the low melting point metal 23, whereby the inappropriate electric connection can be avoided. Similarly, since a vibration is absorbed by the thin part 51 and the notches 53*a*, 53*b* in pairs, it is possible to prevent the vibration from being transmitted to the joint part on the low melting point metal 23.

Figure 8:
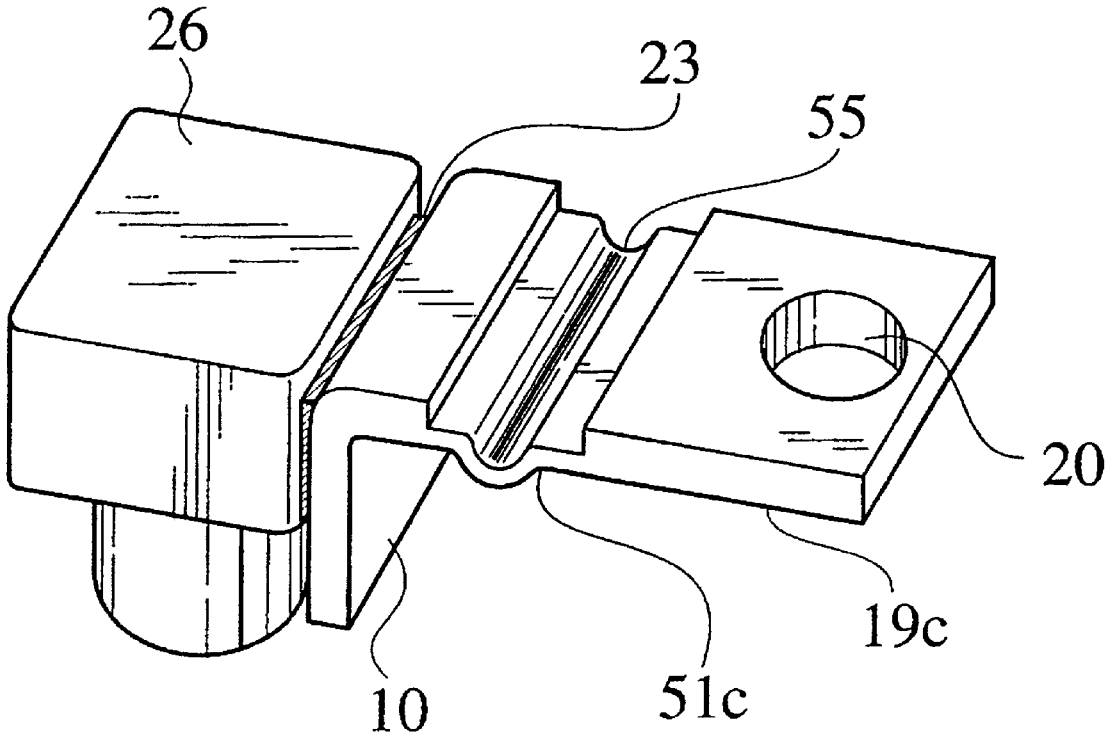
FIG. 8 is a perspective view of the thermit casing and the bus-bar in the second modification of the circuit breaking device.

Next, we describe the second modification of the circuit breaking device of the invention. FIG. 8 is a perspective view of the thermit casing and the bus-bar of the circuit breaking device, in accordance with the second modification of the embodiment.

Also in the modification, a second bus-bar 19*c* has the orifice 20 formed on one end of the bar and a thin part 51*c* formed between the orifice 20 and the joint part of the low melting point metal 23. Further, the thin part 51*c* has a depressed part 55 formed so as to traverse the thin part 51*c* in its width direction. The depressed part (dent) 55 constitutes irregularities of the invention. Note, the dent may be replaced by a projection formed on the thin part 51*c*.

The bending part 10 is welded to the thermit casing 26 through the low melting point metal 23. Note, the first bus-bar (not shown) has a structure identical to that of the above-mentioned second bus-bar 19*c* and therefore, the descriptions are eliminated.

With the above-mentioned arrangement, for example, when performing to insert the screw into the orifice 20 and subsequently fastening the screw in the clockwise direction or counterclockwise direction, the screwing stress is absorbed by the deformation of the thin part 51 and the depressed part 55 in the rotating direction. Thus, it is possible to prevent the screwing stress from being transmitted to the joint part on the low melting point metal 23, whereby the inappropriate electric connection can be avoided. Similarly, since a vibration is absorbed by the thin part 51 and the depressed part 55, it is possible to prevent the vibration from being transmitted to the joint part on the low melting point metal 23.

Although the invention has been described above by reference to some embodiments of the invention, the invention is not limited to the embodiments described above. Modifications and variations of the embodiments described above will occur to those skilled in the art, in light of the above teachings. For example, although the first and second busbars 11, 19 are respectively provided with the thin parts 51 and the notches 53 in the embodiment, the bus-bars 11, 19 in the modification may be provided with the thin parts 51 only.

Further, although the circuit breaking device of the embodiment is constructed so as to cut off the circuit when the second projections 41 and the low melting point metals 23 are molten, only the second projections 41 may be formed in the circuit breaking device without the low melting point metals 23, in the modification. In such a case, the circuit would be cut off when only the second projections 41 are molten. Of course, further modifications and variations of the embodiments described above will occur to those skilled in the art, in light of the above teachings.

DEPOSIT OF COMPUTER PROGRAM LISTINGS

Not Applicable.

What is claimed is:

1. A connecting terminal for connection with a wire and an electrically conductive member, comprising:

a terminal body in the form of an electrically conductive plate;

a screw-fastening part of the terminal body, which is positioned on an end portion thereof, for electrical connection with the wire;

a leading part of the terminal body, which is positioned on the other end of the terminal body, for electrical connection with the electrically conductive member; and a thin part of the terminal body, which is interposed between the screw-fastening part and the leading part and which has a plate thickness smaller than the plate thickness of other parts of the terminal body.

2. A connecting terminal as claimed in claim 1, wherein the thin part is provided, on opposing edges thereof, with notches.

3. A connecting terminal as claimed in claim 2, wherein the screw fastening part comprises an orifice for receiving a screw.

4. A connecting terminal as claimed in claim 3, wherein at least one portion of the leading part is bent at general right angles to the thin part and the screw-fastening part.

5. A connecting terminal as claimed in claim 3, wherein the leading part and thin part are together bent at general right angles to the screw-fastening part.

6. A connecting terminal as claimed in claim 1, wherein the thin part is provided with irregularities.

7. A connecting terminal as claimed in claim 6, wherein the screw-fastening part comprises an orifice for receiving a screw.

8. A connecting terminal as claimed in claim 7, wherein at least one portion of the leading part is bent at general right angles to the thin part and the screw-fastening part.

9. A connecting terminal as claimed in claim 8, wherein the irregularities comprise at least one depression traversing the thin part in its width direction.

10. A connecting terminal as claimed in claim 8, wherein the irregularities comprise at least one projection traversing the thin part in its width direction.

* * * * *